US008650696B1

(12) United States Patent
Morales et al.

(10) Patent No.: US 8,650,696 B1
(45) Date of Patent: Feb. 18, 2014

(54) SEWER CLEANING APPARATUS

(76) Inventors: Nathaniel Morales, Pleasanton, CA (US); Cody White, West Linn, OR (US)

( * ) Notice: Subject to any disclaimer, the term of this patent is extended or adjusted under 35 U.S.C. 154(b) by 324 days.

(21) Appl. No.: 13/026,739

(22) Filed: Feb. 14, 2011

Related U.S. Application Data

(60) Provisional application No. 61/305,405, filed on Feb. 17, 2010.

(51) Int. Cl.
*B08B 9/04* (2006.01)

(52) U.S. Cl.
USPC ..... 15/104.31; 15/104.14

(58) Field of Classification Search
USPC ..... 15/104.31, 104.14, 104.12, 104.05, 15/104.09, 104.17, 104.18, 104.19, 104.2
See application file for complete search history.

(56) References Cited

U.S. PATENT DOCUMENTS

| | | | | | |
|---|---|---|---|---|---|
| 1,531,439 | A | * | 3/1925 | Haydock et al. | 15/104.061 |
| 1,796,337 | A | * | 3/1931 | Moore | 15/104.2 |
| 1,863,950 | A | * | 6/1932 | Stubbs | 15/179 |
| 2,038,004 | A | * | 4/1936 | Russell | 15/104.09 |
| 2,038,170 | A | * | 4/1936 | Flavin | 15/104.32 |
| 2,051,700 | A | * | 8/1936 | Emanuel | 15/104.32 |
| 2,304,023 | A | * | 12/1942 | Nilsson | 15/104.18 |
| 2,518,330 | A | * | 8/1950 | Jasper et al. | 254/134.5 |
| 2,552,339 | A | * | 5/1951 | Moon | 15/104.061 |
| 2,622,255 | A | * | 12/1952 | Ver Nooy | 15/104.061 |
| 3,056,155 | A | * | 10/1962 | Harmes | 15/104.061 |
| 3,545,026 | A | * | 12/1970 | Beer | 15/183 |
| 3,604,042 | A | * | 9/1971 | Bremner et al. | 15/104.13 |
| 4,027,349 | A | * | 6/1977 | Clavin | 15/104.12 |
| 4,181,998 | A | * | 1/1980 | Nelson | 15/104.14 |
| 4,353,143 | A | * | 10/1982 | Beaudoin et al. | 15/104.066 |
| 4,520,524 | A | * | 6/1985 | Long, Jr. | 15/104.31 |
| 5,146,644 | A | * | 9/1992 | Crocco | 15/104.12 |
| 5,418,997 | A | * | 5/1995 | DeFrange | 15/104.31 |
| 5,588,171 | A | * | 12/1996 | Hamann | 15/104.12 |
| 5,617,604 | A | * | 4/1997 | Erich | 15/104.063 |
| 5,829,521 | A | * | 11/1998 | Brown, Jr. | 166/173 |
| 5,899,795 | A | * | 5/1999 | Penza | 451/61 |
| 5,947,203 | A | * | 9/1999 | Brown, Jr. | 166/311 |
| 6,173,469 | B1 | * | 1/2001 | Laymon | 15/104.061 |
| 6,264,537 | B1 | * | 7/2001 | Penza | 451/51 |
| 6,390,927 | B1 | * | 5/2002 | Cleveland, III | 464/119 |
| 6,464,010 | B1 | * | 10/2002 | Brown | 166/311 |
| 6,775,872 | B1 | * | 8/2004 | Appleton et al. | 15/104.16 |
| 6,964,077 | B2 | * | 11/2005 | Kadinger et al. | 15/104.03 |
| 7,005,012 | B2 | * | 2/2006 | Bourrelly et al. | 134/8 |
| 7,124,882 | B1 | * | 10/2006 | Jadydy | 206/234 |

(Continued)

FOREIGN PATENT DOCUMENTS

JP 2008249213 A * 10/2008

*Primary Examiner* — Joseph J Hail
*Assistant Examiner* — Marc Carlson
(74) *Attorney, Agent, or Firm* — Gerald R. Prettyman

(57) ABSTRACT

A sanitary sewer cleaning apparatus for removing roots and debris with a segmented circular brush attached to a rodder root removal tool. As the apparatus travels through a sewer line, the segmented brushes, which are mounted on hinges, fold back to reduce drag and facilitate movement through obstructed sewers. As the rodder pulls back the apparatus, the brushes engage the walls of the pipe to pull roots and debris to the sewer access point. The preferred embodiments comprises rodder coupler, an extension arm for coupling a plurality of brushes in a radial configuration, a plurality of brushes for collecting the root infiltration debris, and a plurality of hinges for angularly altering the plurality of brushes relative to the apparatus.

8 Claims, 9 Drawing Sheets

(56) References Cited

U.S. PATENT DOCUMENTS

| | | | | |
|---|---|---|---|---|
| 7,707,675 | B2 * | 5/2010 | Van Bogaert | 15/104.12 |
| 8,146,196 | B2 * | 4/2012 | Seo | 15/104.16 |
| 2006/0042032 | A1 * | 3/2006 | Van Bogaert | 15/104.12 |
| 2006/0130251 | A1 * | 6/2006 | Bourrelly | 15/104.09 |
| 2007/0161339 | A1 * | 7/2007 | Wentworth et al. | 451/51 |
| 2009/0044352 | A1 * | 2/2009 | Seo | 15/104.09 |
| 2010/0263144 | A1 * | 10/2010 | Morris | 15/104.09 |
| 2011/0107535 | A1 * | 5/2011 | Osaland | 15/104.09 |

* cited by examiner

SEWER CLEANING APPARATUS

CROSS-REFERENCE TO RELATED APPLICATIONS

This application claims the benefit of priority of U.S. Provisional Application Ser. No. 61/305,405 titled "SEWER CLEANING APPARATUS" filed Feb. 17, 2010, which is hereby incorporated by reference.

BACKGROUND

1. Field of the Invention

This invention pertains to equipment for clearing pipe blockages, and particularly to an apparatus for removing root infiltration debris from inside a sewer pipe.

2. Description of the Prior Art

Roots grow into cracks and joints in sanitary sewer pipes while in the search of water and nutrients. A major cause of sanitary sewer pipe blockages is root infiltration, and it is common for a root to completely fill a sanitary sewer pipe and block flow. One method of root removal is insertion a tool called a rodder into the sanitary sewer pipe via a access manhole. The rodder tool rotates about 150 times per minute. The expandable blades of the rodder tool cut the roots from the inside the sanitary sewer line but leave the root debris in the pipe. Sanitary sewer flows push the root infiltration debris downstream to an outflow point, or to a point where the root infiltration debris is either blocked by a restriction in the sewer pipe, or the root infiltration debris collects sufficiently during low flow to block the pipe. Either situation effectively dams the sanitary sewer pipe and causes an upstream sanitary sewer overflow. The primary goal of all wastewater collection systems maintenance groups is the prevention of sanitary sewer overflows (SSO's). An SSO is both a public health risk and can result in a significant regulatory fine.

SUMMARY OF THE INVENTION

Disclosed is an apparatus for removing root infiltration debris from inside a sanitary sewer pipe. In an exemplary embodiment, the apparatus comprises a rodder coupler for connecting a rodder tool to an apparatus for removing root infiltration debris from inside a sanitary sewer pipe, a flexible joint coupled to the rodder coupler for allowing the apparatus to comport to circular bends in the sanitary sewer pipe and for reducing skew misalignment of the apparatus, a flexible arm coupled to the rodder coupler and concentrically proximate to the flexible joint for providing stiffness to the apparatus to decrease droop from gravity and loss of root infiltration debris, an extension arm coupled to the rodder coupler for coupling a plurality of brushes in a radial configuration relative to the rodder coupler, a plurality of brushes coupled to the extension arm for collecting root infiltration debris from inside a sanitary sewer pipe, a plurality of brush springs coupling the plurality of brushes to the apparatus for orienting the plurality of brushes relative to the sanitary sewer pipe to facilitate orientation of the plurality of brushes for collecting the root infiltration debris for removal, a plurality of hinges coupling the plurality of brushes to the extension arm for angularly altering the plurality of brushes relative to the apparatus for orienting the plurality of brushes to facilitate orientation of the plurality of brushes for collecting the root infiltration debris for removal, and a penetrating tip coupled to the extension arm for pushing aside root infiltration debris to allow the apparatus to travel through root infiltration.

Alternate embodiments may comprise a swivel coupled to the rodder coupler for isolating rotation of the rodder tool from the apparatus for removing root infiltration debris from inside a sanitary sewer pipe, or an extension rod for providing a clearance distance between the rodder tool and the plurality of brushes.

In some embodiments, the flexible joint is a universal joint. In some embodiments the flexible arm may be a compression spring or a torsion spring.

In some embodiments, at least one of the plurality of brushes is affixed to the extension arm at an angle less than or equal to ten degrees relative to a longitudinal centerline of the apparatus. In other embodiments, at least one of the plurality of brushes is affixed to the extension arm at an angle exceeding ten degrees relative to a longitudinal centerline of the apparatus.

In some embodiments, at least one of the plurality of brush springs may be a torsion spring, a compression spring, or a tension spring.

DETAILED DESCRIPTION OF THE INVENTION

Figure 1:
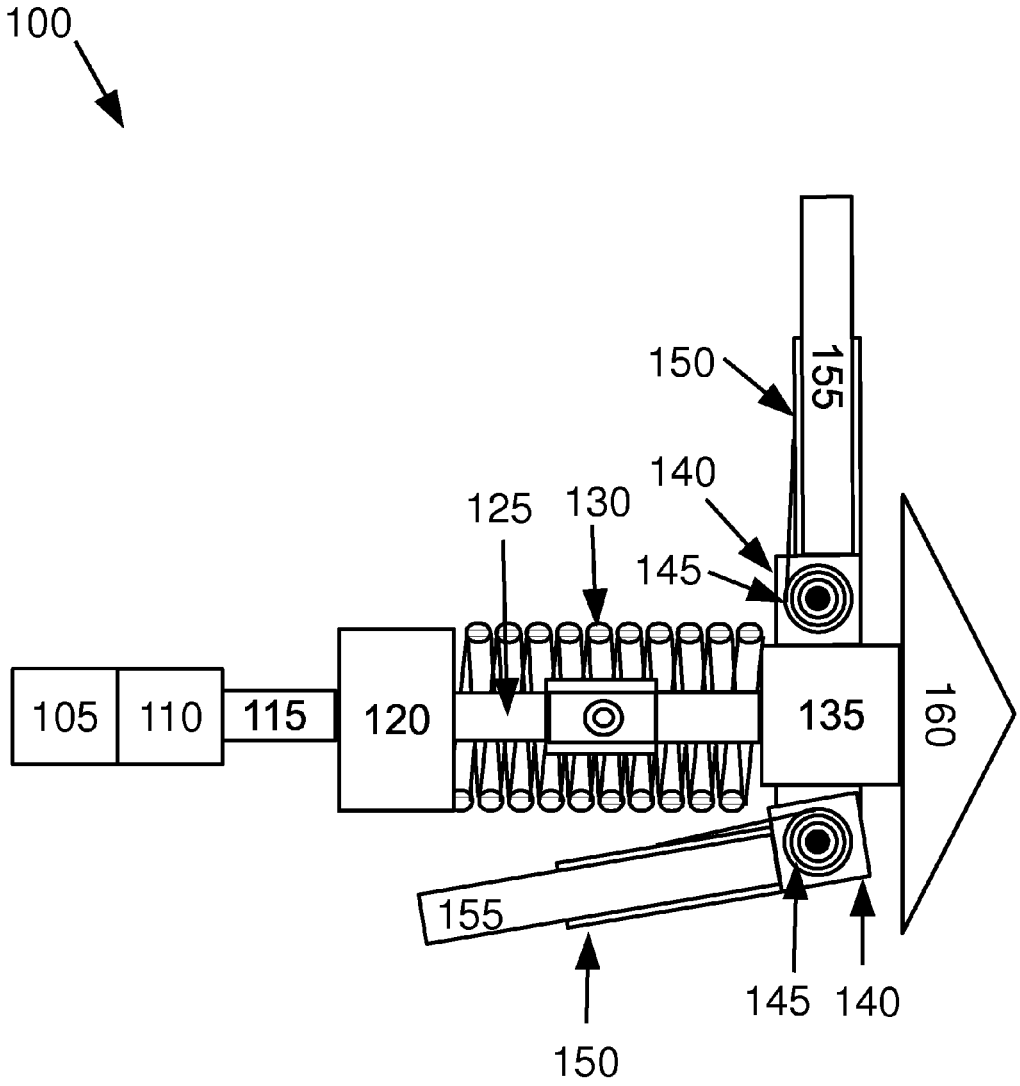
FIG. 1 illustrates an exemplary apparatus 100 for removing root infiltration debris from inside a sanitary sewer pipe.

FIG. 1 illustrates an exemplary apparatus 100 for removing root infiltration debris from inside a sanitary sewer pipe. The apparatus may comprise a rodder coupler 105, a swivel 110, an extension rod 115, a coupler nut 120, a flexible joint 125, a flexible arm 130, an extension arm 135, a plurality of hinges 140, a plurality of brush springs 145, a plurality of brush supports 150, a plurality of brushes 155, and a penetrating tip 160.

The rodder coupler 105 provides for connecting the apparatus 100 for removing root infiltration debris from inside a sanitary sewer pipe to a rodder tool (not shown). The rodder coupler 105 may comprise one or more fastening systems. In an exemplary embodiment, the rodder coupler 105 may be a threaded nut. In some embodiments, the rodder coupler 105 is connected to the swivel 110. The rodder coupler 105 may be formed from any material of sufficient strength to securely fasten the apparatus 100 to the rodder without fracture or other failure that could leave the apparatus 100 in the sanitary sewer pipe. In some embodiments, the rodder coupler 105 may be steel, iron, aluminum, brass, chrome steel, etc. To assure that the rodder coupler 105 does not loosen, the rodder coupler 105 should be appropriated threaded so as to not loosen during rodder rotation.

The swivel 110 provides for separating the rotation of the rodder from the apparatus 100. While the rodder blades must rotate, rotation of the apparatus 100 could allow debris to escape. Consequently, the swivel 110 is used to prevent rotation of the apparatus 100. In some embodiments, the swivel 110 may be a ball and socket with the ball (vice versa, the socket) attached to the rodder coupler 105 and the opposing portion of the swivel 110 connected to the extension rod 115. In some embodiments, the swivel 110 is connected elsewhere between the rodder tool and the extension arm 135.

The swivel 110 may be formed from any material of sufficient strength to function without fracture or other failure that could leave the apparatus 100 in the sanitary sewer pipe. In some embodiments, the swivel 110 may be steel, iron, aluminum, brass, chrome steel, etc.

The extension rod 120 connects the swivel 110 to the coupler nut 120. In some embodiments, the extension rod 120 may have a ball or socket at one end coupled to the swivel 110 (if present) with "all-thread" coupled to the coupler nut 120.

The extension rod 115 may also provide a clearance distance between the rodder tool and the plurality of brushes 155. Cumulatively, the extension rod 115 must be of sufficient length so that with the length of the coupler nut 120, and the length of the flexible joint 125, that the plurality of brushes 155 do not contact the rodder blades, which could damage the rodder blades (as well as the plurality of brushes 155), or add further debris to the sanitary sewer pipe. Consequently, the length of the extension rod 115 is proportional to the height of the plurality of brushes 155 and is inversely proportional to the length of the flexible joint 125.

Some embodiments may omit the extension rod 115 as a separate component and incorporate the core functions of component connectivity and clearance distance into other components.

The extension rod 115 may be formed from any material of sufficient strength to function without fracture or other failure that could leave the apparatus 100 in the sanitary sewer pipe. In some embodiments, the extension rod 115 may be steel, iron, aluminum, brass, chrome steel, etc.

The coupler nut 120 provides for connecting the extension rod 115 to the flexible joint 125. In some embodiments, the coupler nut 120 may be threaded for coupling to the extension rod 115, or to the flexible joint 125, or to both. In some embodiments, the coupler nut 120 may be a plurality of nuts secured to the opposing ends of a tube or rod, so that a nut at one end is secured to the extension rod 115 while another nut at the opposing end of the tube or rod is secured to the flexible joint 125.

In some embodiments, the coupler nut 120 also provides a securing one end of the flexible arm 130. In these embodiments, the coupler nut 120 may incorporate a weld or a mechanical coupler, including but not limited to a circumferential clamp, or interlocking bolts with or without pins, etc. Any form of coupling for connecting the extension rod 115 to the flexible arm 130 is sufficient.

The coupler nut 120 may be formed of any material of sufficient strength to prevent fracture or other failure that could leave the apparatus 100 in the sanitary sewer pipe. To assure that the coupler nut 120 does not loosen, the coupler nut 120 should be appropriated threaded so as to not loosen during rodder rotation.

The flexible joint 125 connects the coupler nut 120 to the extension arm 135 and provides the ability of the apparatus 100 to conform to circular bends in the sanitary sewer pipe as the apparatus 100 moved through the sanitary sewer pipe. In some embodiments, the flexible joint 125 provides one-degree of freedom of bending for the apparatus 100. In some embodiments, the flexible joint 125 provides two-degrees of freedom of bending for the apparatus 100. In some embodiments, the flexible joint 125 may be a universal joint ('u joint').

The flexible joint 125 may be formed of any material of sufficient strength to prevent fracture or other failure that could leave any part of the apparatus 100 in the sanitary sewer system. In some embodiments, the flexible joint 125 may be steel, iron, aluminum, brass, chrome steel, etc.

The flexible arm 130 provides a nominal resistive force to bending to allow the apparatus 100 to bend at the flexible joint and yet maintain a nominally straight configuration.

In an exemplary embodiment, the flexible arm 130 is secured between the coupler nut 120 and the extension arm 135. The flexible arm 130 may be secured to the coupler nut 120 by welding, with a mechanical clamp, or by any material and method of sufficient strength to prevent fracture or other failure that could leave any part of the apparatus 100 in the sanitary sewer system. The flexible arm 130 may be secured to the extension arm 135 by welding, with a mechanical clamp, or by any material and method of sufficient strength to prevent fracture or other failure that could leave any part of the apparatus 100 in the sanitary sewer system.

In an exemplary embodiment, the flexible arm 130 is a compression spring with the flexible joint 125 inside the flexible arm 130, i.e. the flexible arm 130 is concentrically proximate to the flexible joint 125. This configuration improves and stabilizes the operation of the apparatus 100. The flexible joint 125 adds rigidity, which aids to avoid damage or failure from skew misalignment, which may occur with the flexible arm 130 alone. The flexible arm 130 provides stiffness along the direction of travel so that plurality of brushes are less likely to droop from gravity and lose debris, which may occur with the flexible joint 125 alone.

In some embodiments, the flexible arm 130 comprises steel. In other embodiments, the flexible arm 130 may comprise another metal. In some embodiments, the flexible arm 130 may comprise another flexible element. The embodiments may comprise a rubber or elasticized plastic tube or pipe, or other flexible material.

The extension arm 135 provides for securing the plurality of brushes 155 to the apparatus 100, as well as for connecting the penetrating tip 160 to the apparatus 100. In an exemplary embodiment, the extension arm 135 is secured on one side to the flexible joint 125 with the flexible arm 130 outside the flexible joint 125, with the penetrating tip 160 secured on the opposing side of the extension arm 135, while the plurality of brushes 155 are secured around the circumference of the extension arm 135 at the plurality of hinges 140.

The extension arm 135 may have any geometry for attaching the plurality of brushes 155 to the apparatus 100 via the plurality of hinges 140. In an exemplar embodiment, the extension arm 135 is a square tube of flat sides with a nut welded at one end for the flexible joint 125 and four flat sides. Secured to each flat side of the extension arm 135 at one of the plurality of hinges 140 is one of the plurality of brush springs 145. Also attached to the extension arm 135 is the penetrating tip 160, as described herein.

The extension arm 135 may be formed of any material of sufficient strength to prevent fracture or other failure that could leave any part of the apparatus 100 in the sanitary sewer system. In some embodiments, the extension arm 135 may be steel, iron, aluminum, brass, chrome steel, etc.

The plurality of hinges 140 provide for affixing the plurality of brushes 155 to the apparatus 100 and for altering (rotating) each of the plurality of brushes 155 relative to the apparatus 100. See FIG. 2.

The plurality of hinges 140 may be attached to, or may be a part of the extension arm 135. In an exemplary embodiment, each of the plurality of hinges 140 is welded to the extension arm 135. In some embodiments, the plurality of hinges 140 may be affixed to the extension arm 135 by another material blending technique. In some embodiments, the plurality of hinges 140 may be bolted or fastened in some other technique to the extension arm 135.

The plurality of hinges 140 may be formed of any material of sufficient strength to prevent fracture or other failure that could leave any part of the apparatus 100 in the sanitary sewer system. In some embodiments, the plurality of hinges 140 may be steel, iron, aluminum, brass, chrome steel, etc.

The plurality of brush springs 145 provide for deploying the plurality of brushes 155 to an extended position so the plurality of brushes 155 can collect root infiltration debris as the rodder tool and the apparatus 100 are retrieved from the sanitary sewer pipe. In an exemplary embodiment, each of the plurality of brush springs 145 is attached to one of the plurality of brush supports 150, with each of the plurality of brush supports 150 holding one of the plurality of brushes 155. See FIG. 2.

Figure 3:
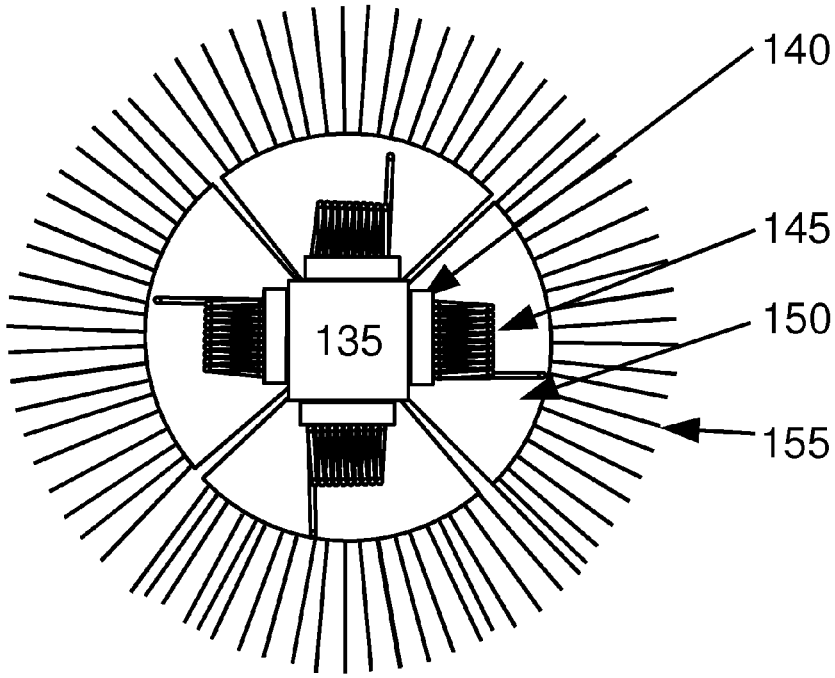
FIG. 3 illustrates a view of the exemplary embodiment 300 to show the plurality of brushes in the deployed position as viewed from the rodder tool.
Figure 8:
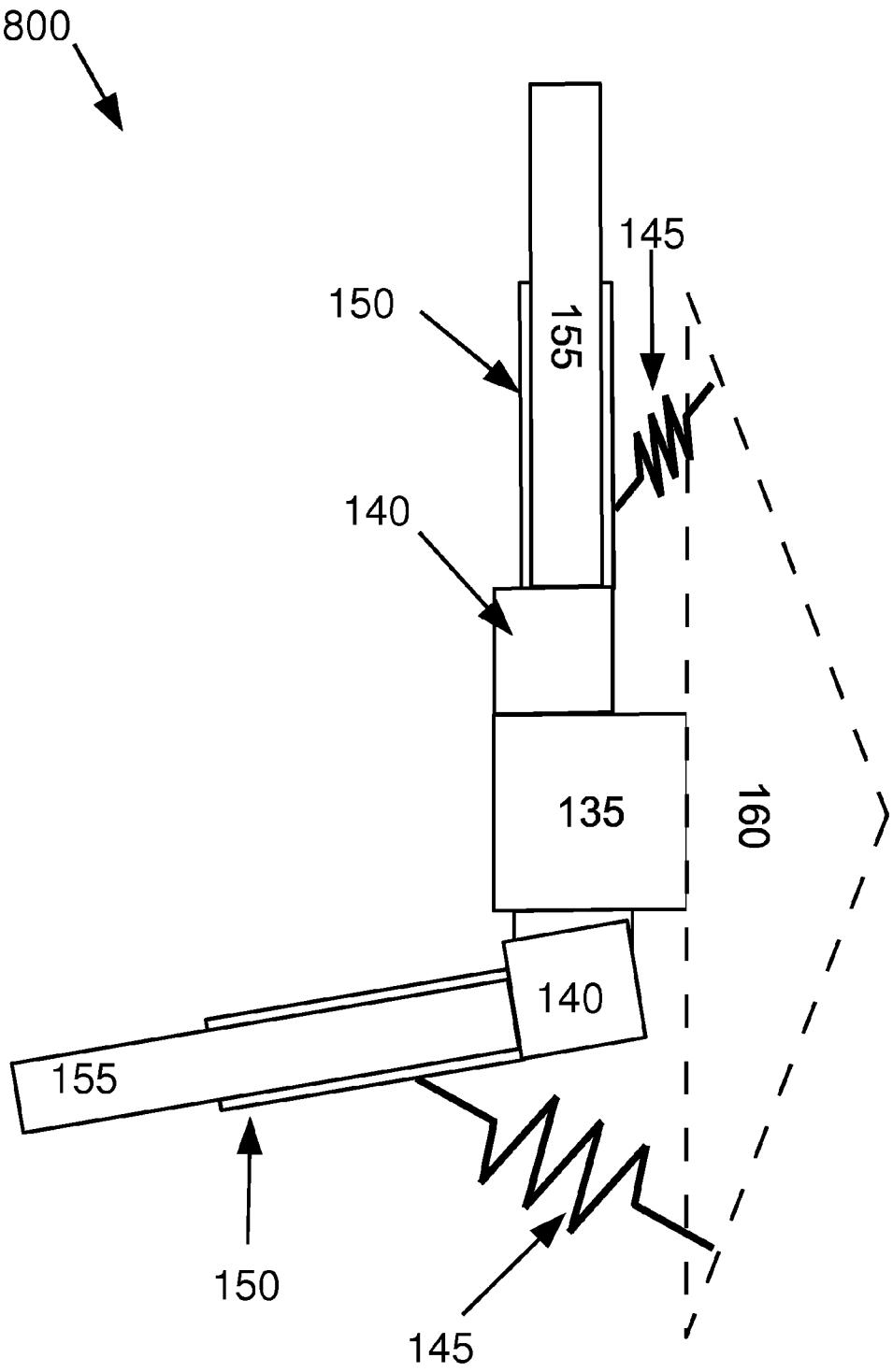
FIG. 8 illustrates an exemplary alternative embodiment 800 of the apparatus 100 showing at least one of the plurality of brush springs as a compression spring.
Figure 9:
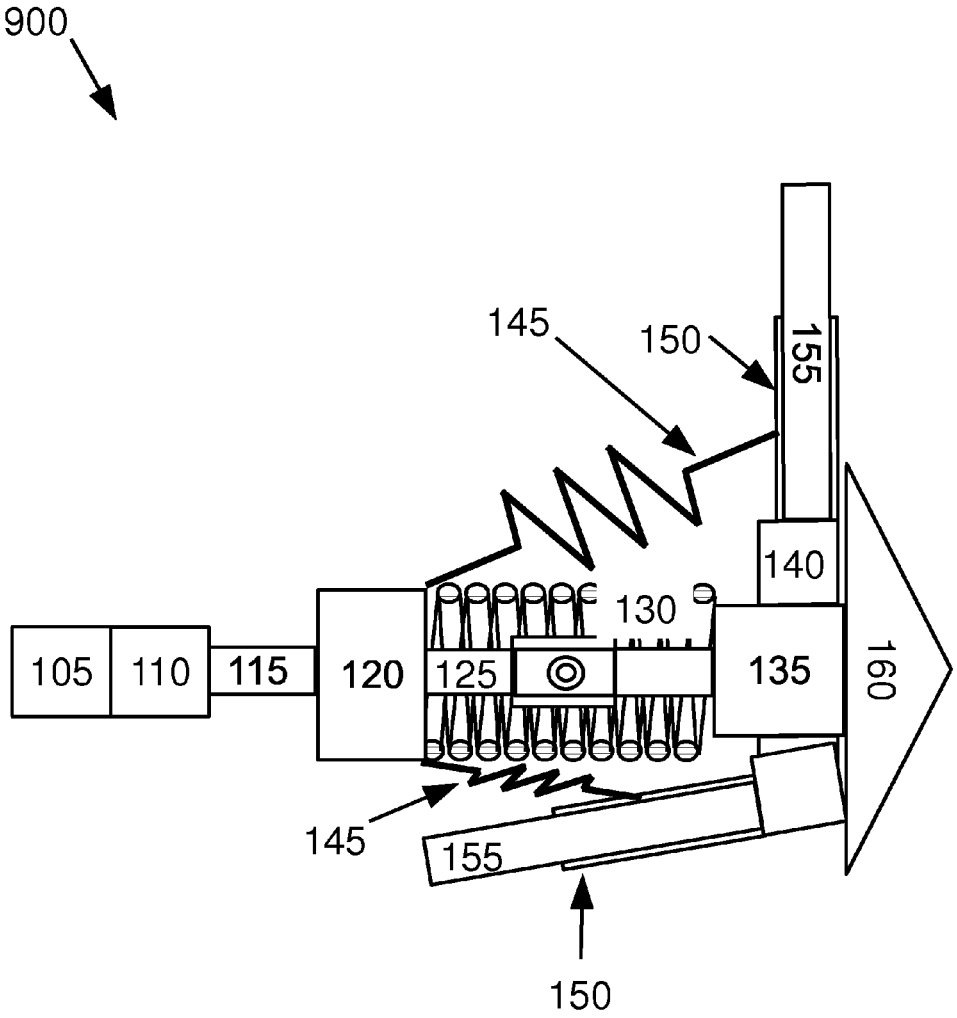
FIG. 9 illustrates an exemplary alternative embodiment 900 of the apparatus 100 showing at least one of the plurality of brush springs as a tension spring.

In an exemplary embodiment, at least one of the plurality of brush springs 145 is a torsion spring as illustrated in FIG. 3. In some embodiments at least one of the plurality of brush springs is a compression spring as illustrated in FIG. 8. In some embodiments at least one of the plurality of brush springs is a tension spring as illustrated in FIG. 9.

In some embodiments, each of the plurality of hinges 140 and each of the plurality of brush springs 145 may be incorporated concentrically so the that each of the plurality of hinges 140 and each of the brush springs 145 rotate together as illustrated in FIG. 3.

Figure 4:
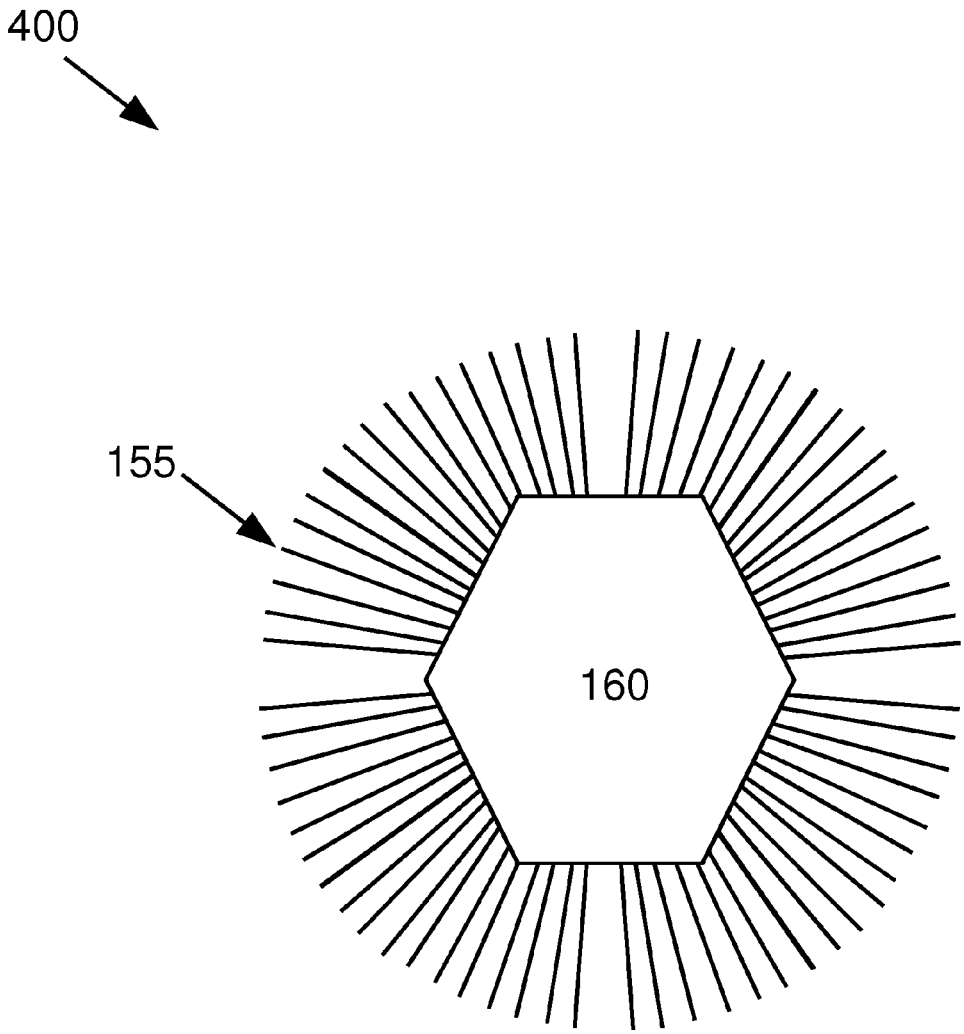
FIG. 4 illustrates a view of the exemplary embodiment 400 to show the oncoming apparatus 100 as viewed from uncut root infiltration into which the apparatus 100 is moving.

In some embodiments, each of the plurality of hinges 140 may be installed separated to the extension arm 135, with each of the plurality of brush springs 145 affixed to a side of each of the plurality of hinges 140 as illustrated in FIG. 4.

The plurality of brush springs 145 may be formed of any material of sufficient strength to prevent fracture or other failure that could leave any part of the apparatus 100 in the sanitary sewer system. In some embodiments, the plurality of brush springs 145 may be steel, iron, aluminum, brass, chrome steel, etc.

Figure 2:
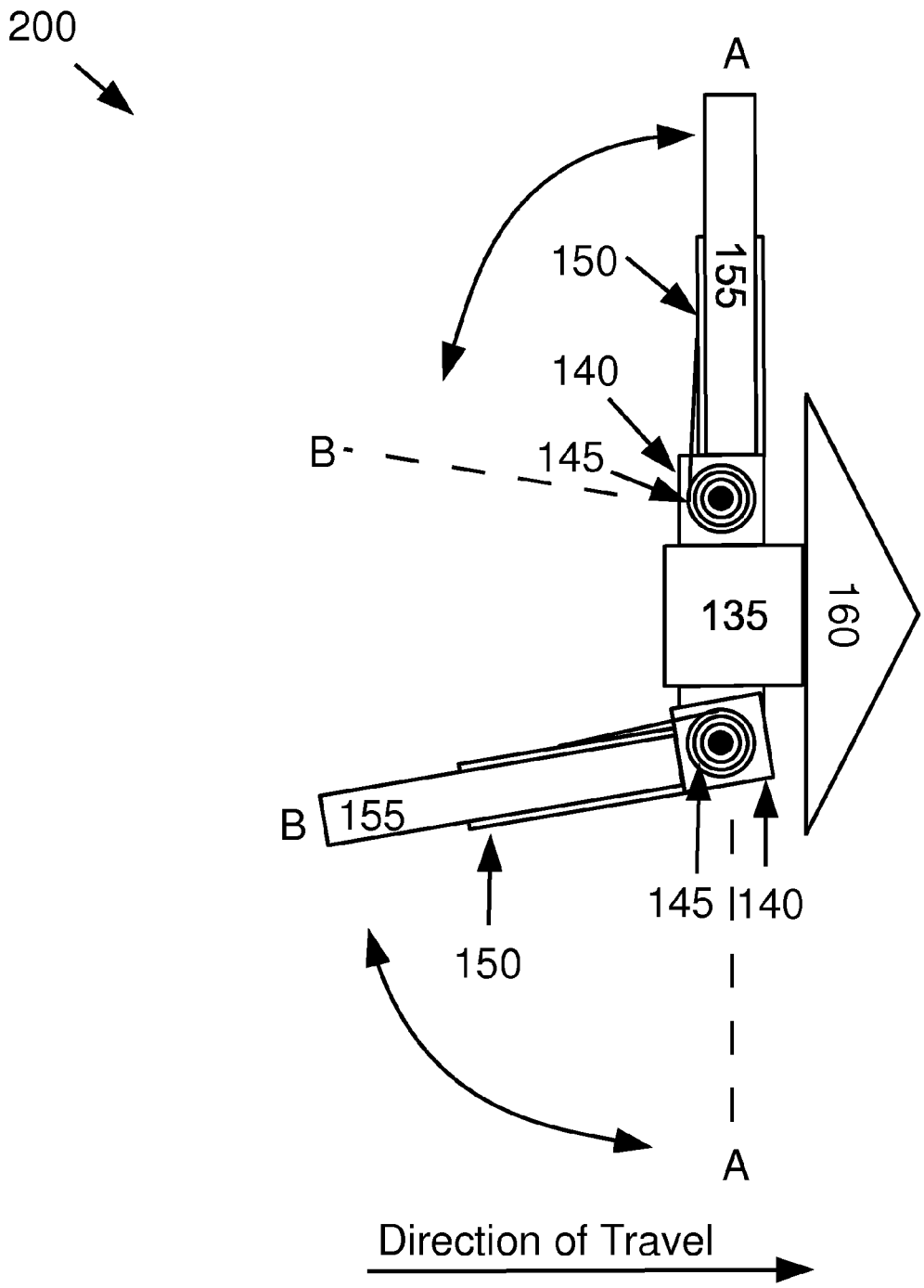
FIG. 2 illustrates the components of the apparatus 100 for folding and deploying the plurality of brushes.

The plurality of brush supports 150 hold and support the individual brushes of the plurality of brushes 155. In an exemplary embodiment, each of the plurality of brush supports 150 is affixed to one of the plurality of brushes 155, and is attached to one of the plurality of hinges 140 to hold the plurality of brushes 155 to the apparatus 100. FIG. 2 provides addition support on the function of the plurality of brush supports 150.

The plurality of brush supports 150 may be formed of any material of sufficient strength to prevent fracture or other failure that could leave any part of the apparatus 100 in the sanitary sewer system. In some embodiments, the plurality of brush supports 150 may be steel, iron, aluminum, brass, chrome steel, etc.

The plurality of brushes 155 provide for collecting root infiltration debris as the rodder tool and apparatus 100 are retracted. In an exemplary embodiment, the plurality of brushes 155 are coupled to the extension arm to have a radial configuration relative to the rodder coupler. Further details regarding the plurality of brushes 155 are discussed in regards to FIGS. 2, 3, 4, 5 and 6.

The plurality of brushes 155 may be formed of any material of sufficient strength to prevent fracture or other failure that could leave any part of the apparatus 100 in the sanitary sewer system. In some embodiments, the plurality of brushes 155 may be steel, iron, aluminum, brass, chrome steel, etc.

The penetrating tip 160 provides for moving aside uncut root infiltration as the apparatus 100 moves through the sanitary sewer pipe. The penetrating tip 160 may have any geometry suitable for moving aside uncut root infiltration. In some embodiments, the penetrating tip 160 may be circular, triangular, square, pentagonal, hexagonal, heptagonal, or octagonal, etc.

The penetrating tip 160 may be secured to the extension arm 135 by any material and method of sufficient strength to prevent fracture or other failure that could leave any part of the apparatus 100 in the sanitary sewer system. In an exemplary embodiment, the penetrating tip 160 is welded to the extension arm 135. In some embodiments, the penetrating tip 160 may be secured to the extension tip 135 by another material blending technique. In some embodiments, the penetrating tip 160 may be bolted or fastened in some other technique to the extension arm 135.

The penetrating tip 160 may be formed of any material of sufficient strength to prevent fracture or other failure that could leave any part of the apparatus 100 in the sanitary sewer system. In some embodiments, the penetrating tip 160 may be steel, iron, aluminum, brass, chrome steel, etc.

FIG. 2 illustrates the components of a exemplary embodiment 200 for folding and deploying the plurality of brushes 155. The components of the exemplary embodiment 200 shown are the extension arm 135, the plurality of hinges 140, the plurality of brush springs 145, the plurality of brush supports 150, and the plurality of brushes 155.

The apparatus 100 moves into uncut root infiltration as shown by the Direction of Travel arrow. The penetrating tip 100 (FIG. 1) at the forward portion of the apparatus 100 moves aside the uncut root infiltration, which may then block the plurality of brushes 155. To lessen the resistive force of the plurality of brushes 155, which may bind the apparatus 100 in the uncut root infiltration, the plurality of hinges 140 allows the plurality of brushes 155 to change the angular relationship with respect to the extension arm 135. The plurality of brushes 155 may travel (rotate) from 30 to 80 degree or more from the extended position "A" toward the extension arm 135 to the folded position "B," thereby permitting the apparatus 100 to move with ease through the sanitary sewer pipe. In some embodiments, at least one of the plurality of brushes 155 comprises a solid scraping surface.

Once the apparatus 100 is clear of the uncut root infiltration, the plurality of brush springs 145 press the plurality of brush supports 150 and the plurality of brushes 155 from the folded position "B" to the extended position "A."

FIG. 3 illustrates a view of the exemplary embodiment 300 to show the plurality of brushes 155 in the deployed position as viewed from the rodder tool. The components of the exemplary embodiment 300 shown are the extension arm 135, the plurality of hinges 140, the plurality of brush springs 145, the plurality of brush supports 150, and the plurality of brushes 155.

As the rodder moves along, the rotating blades cut the root filtration into small pieces. After cutting is completed, the rodder retraction begins and the apparatus 100 is pulled back toward the sanitary sewer pipe access manhole. At this point, each of the plurality of brush supports 150 work in tandem with the plurality of hinges 140 and the plurality of brush springs 145 to provide a positive force on the plurality of brushes 155 towards the extended position "A" of FIG. 2.

As shown in FIG. 3, the plurality of brush springs 145 has pressed the plurality of brush supports 150 and the plurality of brushes 155 into the extended (deployed) position. In this extended (deployed) position, the plurality of brushes 155 can collect root infiltration debris and move the root infiltration debris through the sanitary sewer pipe towards the operators for removal as the rodder tool and apparatus 100 are retracted. In some embodiments, at least one of the plurality of brushes 155 comprises a plurality of wires.

FIG. 4 illustrates a view of the exemplary embodiment 400 to show the oncoming apparatus 100 as viewed from uncut root infiltration into which the apparatus 100 is moving. The components of the exemplary embodiment 400 shown are the plurality of brushes 155 and the penetrating tip 160. In this view, the penetrating tip is positioned to move aside uncut root infiltration, which the plurality of brushes 155 are still in the deployed position before folding back under the resistive force of the uncut root infiltration.

Figure 5:
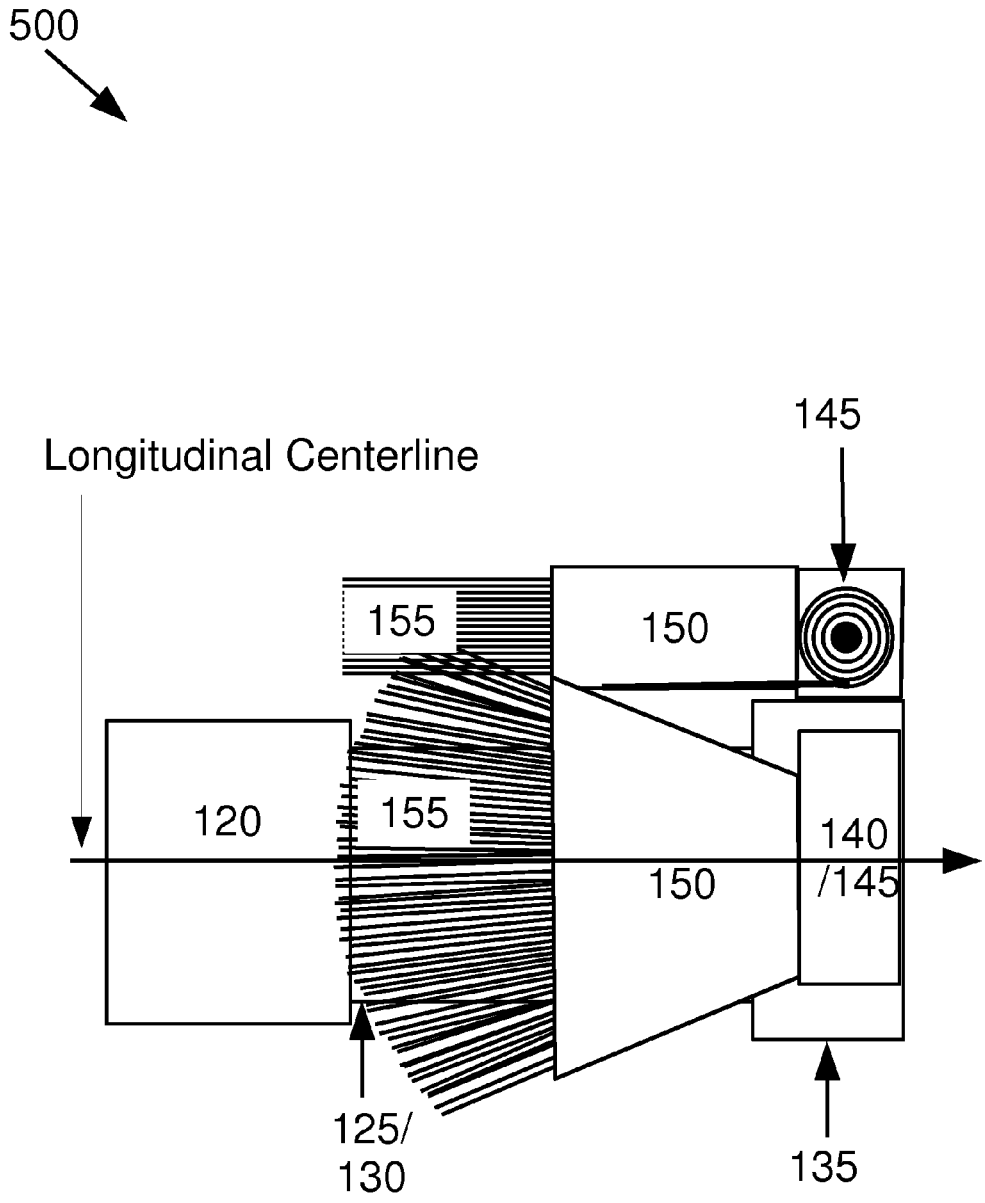
FIG. 5 illustrates an exemplary embodiment 500 of the apparatus 100 showing the plurality of brushes in the folded position.

FIG. 5 illustrates an exemplary embodiment 500 of the apparatus 100 showing the plurality of brushes 155 in the folded position. The components of the exemplary embodiment 500 represented are the coupler nut 120, the flexible joint 125, the flexible arm 130, the extension arm 135, the plurality of hinges 140, the plurality of brush springs 145, the plurality of brush supports 150, and the plurality of brushes 155. Not shown are the rodder coupler 105, the swivel 110, the extension rod 115 and the penetrating tip 160.

As shown in exemplary embodiment 500, one set of the plurality of brush supports 150 and the plurality of brushes 155 in the folded position may overlap an adjacent set. This embodiments may suffer damage to the plurality of brush supports 150 or the plurality of brushes 155. In some embodiments, the plurality of brush supports 150 and the plurality of brushes 155 are reduced in size to avoid such contact.

Figure 6:
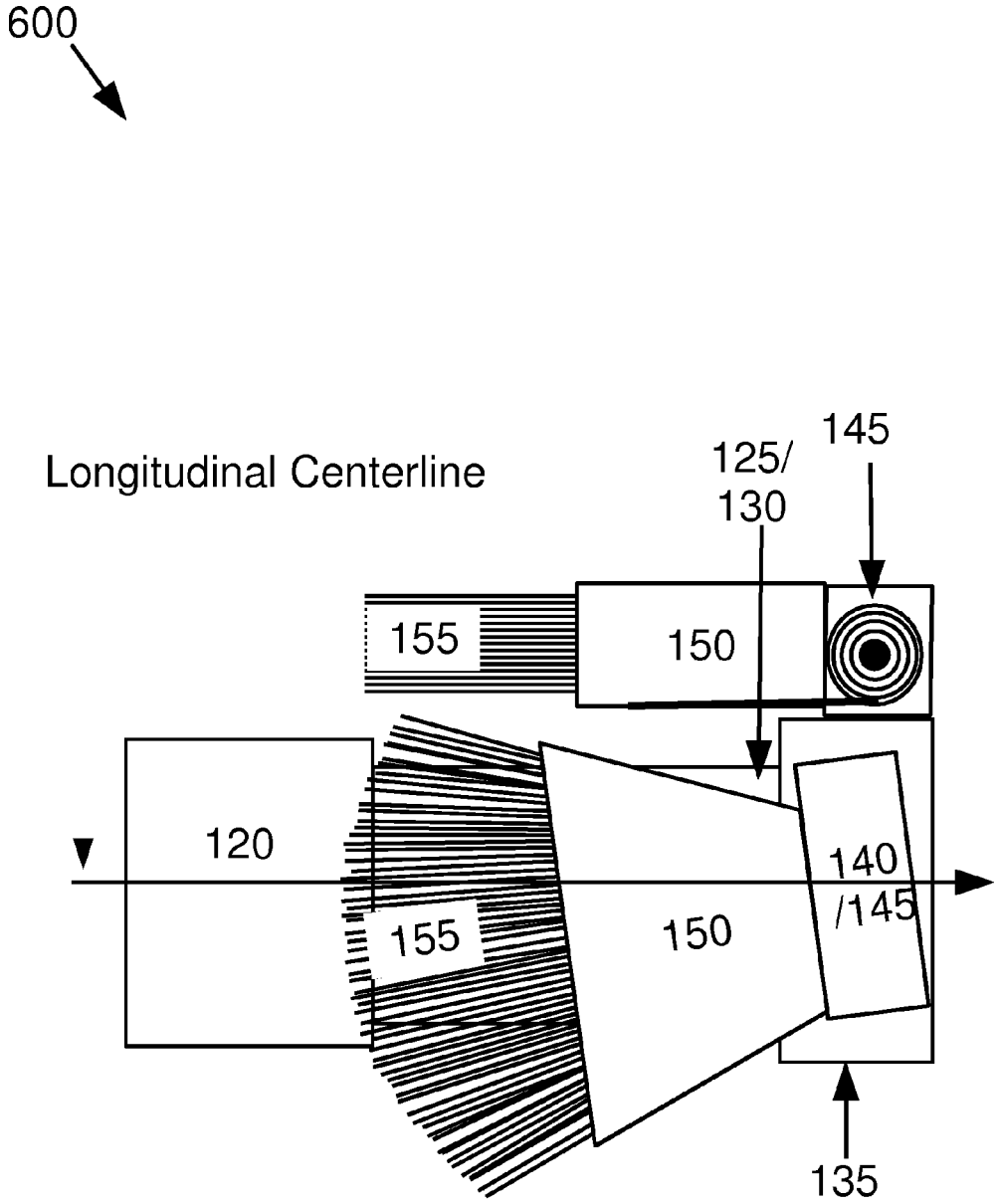
FIG. 6 illustrates an exemplary alternative embodiment 600 of the apparatus 100 showing the plurality of brushes in the folded position.

FIG. 6 illustrates an exemplary alternative embodiment 600 of the apparatus 100 showing the plurality of brushes 155 in the folded position. The components of the exemplary embodiment 600 represented are the coupler nut 120, the flexible joint 125, the flexible arm 130, the extension arm 135, the plurality of hinges 140, the plurality of brush springs 145, the plurality of brush supports 150, and the plurality of brushes 155. Not shown are the rodder coupler 105, the swivel 110, the extension rod 115 and the penetrating tip 160.

Unlike exemplary embodiment 500, however, the plurality of hinges 140, the plurality of brush springs 145, the plurality of brush supports 150, and the plurality of brushes 155 are rotated with respect to the coupler nut 120, the flexible joint 125, the flexible arm 130 and the extension arm 135. Consequently, in the exemplary embodiment 600, each set of the plurality of hinges 140, the plurality of brush springs 145, the plurality of brush supports 150, and the plurality of brushes 155 are less likely to contact one another.

In some embodiments, the rotation of the plurality of brushes 155 may be accomplished by rotating the plurality of hinges 140 with respect to the extension arm 135 prior to affixed the plurality of hinges to the extension arm 135.

Figure 7:
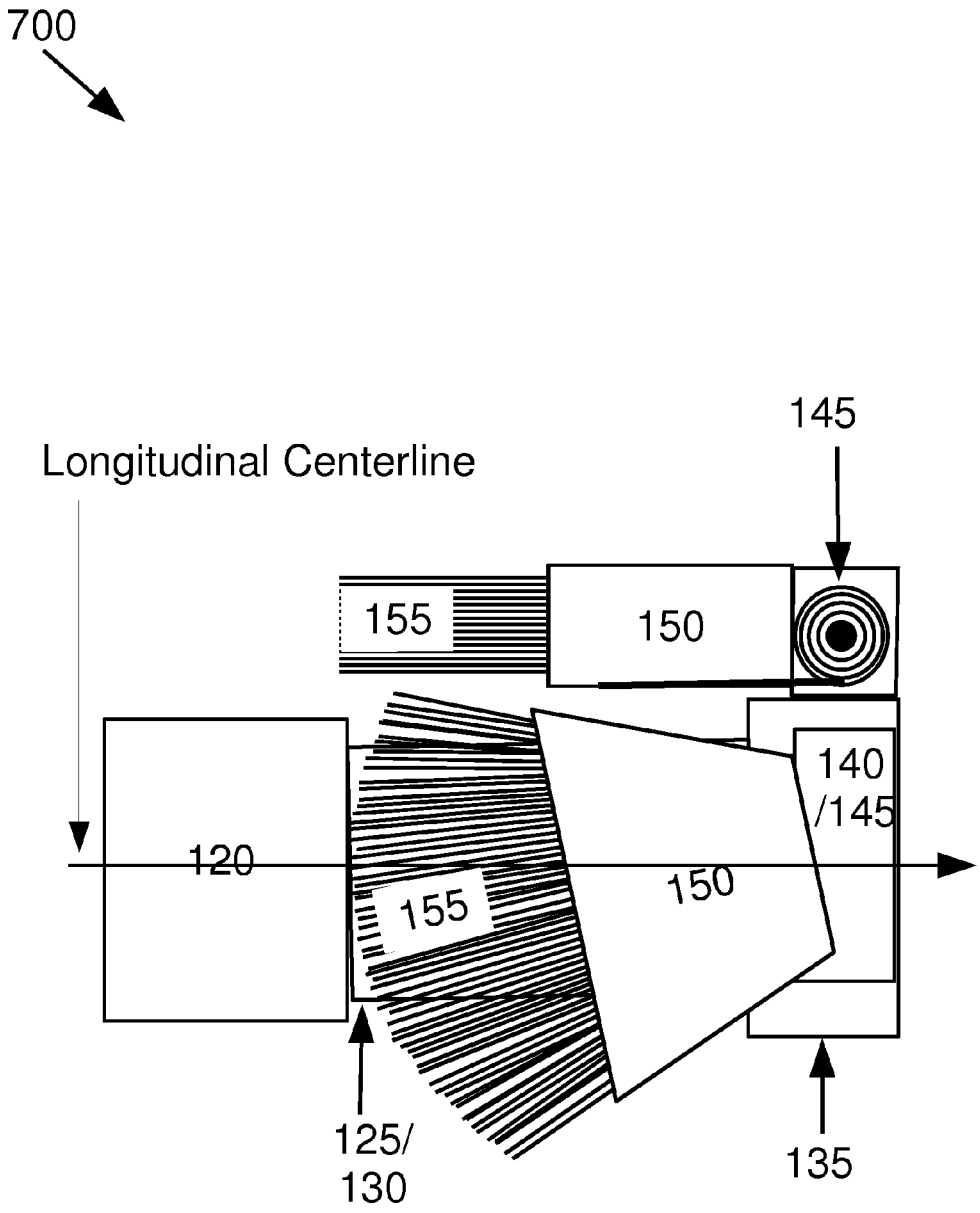
FIG. 7 illustrates an exemplary alternative embodiment 700 of the apparatus 100 showing the plurality of brushes in the folded position.

FIG. 7 illustrates an exemplary alternative embodiment 700 of the apparatus 100 showing the plurality of brushes 155 in the folded position. In some embodiments, the rotation of the plurality of brushes 155 may be accomplished by installing the plurality of brush supports 150 brushes rotated with respect to the plurality of hinges 140.

FIG. 8 illustrates an exemplary alternative embodiment 800 of the apparatus 100 showing at least one of the plurality of brush springs as a compression spring.

FIG. 9 illustrates an exemplary alternative embodiment 900 of the apparatus 100 showing at least one of the plurality of brush springs as a tension spring.

While the described and illustrated invention is in context of a limited number of embodiments, the invention may be embodied in other forms without departing from its essential characteristics. These embodiments are illustrative and are not restrictive. All meanings and equivalency of the claims and description are embraced.

We claim:

1. An apparatus for removing root infiltration debris from inside a sanitary sewer pipe comprising:

a rodder coupler for connecting a rodder tool to an apparatus for removing root infiltration debris from inside a sanitary sewer pipe;

a swivel coupled to the rodder coupler for isolating rotation of the rodder tool from the apparatus for removing root infiltration debris from inside a sanitary sewer pipe;

an extension rod having a proximal end coupled to the swivel and a distal end coupled to a coupler nut; with the coupler nut coupled to a proximal end of a universal joint and to a proximal end of a helical flexible arm which surrounds the universal joint and which are coupled at distal ends of the universal joint and the helical flexible arm to a proximal end of an extension arm having a perimeter around which is coupled to;

a plurality of radially arranged hinges with each hinge having at least one brush spring coupled to at least one brush support with each brush support attached to one of a plurality of radially arranged brushes thereby coupling the plurality of radially arranged brushes to the extension arm for collecting root infiltration debris from inside a sanitary sewer pipe; and a penetrating tip coupled to the extension arm for pushing aside root infiltration debris to allow the apparatus to travel through root infiltration.

2. The apparatus for removing root infiltration debris from inside a sanitary sewer pipe of claim 1 wherein the helical flexible arm is a compression spring.

3. The apparatus for removing root infiltration debris from inside a sanitary sewer pipe of claim 1 wherein the helical flexible arm is a torsion spring.

4. The apparatus for removing root infiltration debris from inside a sanitary sewer pipe of claim 1 wherein at least one of the plurality of brushes is affixed to the extension arm at an angle less than or equal to ten degrees relative to a longitudinal centerline of the apparatus.

5. The apparatus for removing root infiltration debris from inside a sanitary sewer pipe of claim 1 wherein at least one of the plurality of brushes is affixed to the extension arm at an angle exceeding ten degrees relative to a longitudinal centerline of the apparatus.

6. The apparatus for removing root infiltration debris from inside a sanitary sewer pipe of claim 1 wherein at least one of the plurality of brush springs is a torsion spring.

7. The apparatus for removing root infiltration debris from inside a sanitary sewer pipe of claim 1 wherein at least one of the plurality of brush springs is a compression spring.

8. The apparatus for removing root infiltration debris from inside a sanitary sewer pipe of claim 1 wherein at least one of the plurality of brush springs is a tension spring.

* * * * *